United States Patent [19]

Matty et al.

[11] 3,966,149

[45] June 29, 1976

[54] QUAD STATE RECEIVER

[75] Inventors: Thomas C. Matty, North Huntingdon; Arun P. Sahasrabudhe, Monroeville, both of Pa.

[73] Assignee: Westinghouse Electric Corporation, Pittsburg, Pa.

[22] Filed: Mar. 13, 1975

[21] Appl. No.: 558,097

[52] U.S. Cl. ..... 246/34 R; 340/38 L

[51] Int. Cl.[2] ..... B61L 21/06

[58] Field of Search..... 246/28 R, 34 R, 34 CT, 246/167 R, 122 R, 77; 340/38 R, 38 L

[56] References Cited

UNITED STATES PATENTS

| | | | |
|---|---|---|---|
| 3,683,176 | 8/1972 | Crofts | 246/34 CT |
| 3,891,167 | 6/1975 | Perry | 246/34 R |

*Primary Examiner*—Trygve M. Blix
*Assistant Examiner*—Reinhard J. Eisenzopf
*Attorney, Agent, or Firm*—R. G. Brodahl

[57] ABSTRACT

A receiver is disclosed which is used in a transportation vehicle detection system to compare logic conditions in signals which are transmitted from a first vehicle pathway location, with logic conditions which are detected from signals received at a second vehicle pathway location. When first and second enable signals correspond, the signal from an oscillator is transmitted through two pairs of fail-safe AND gates and applied, through a fail-safe OR gate, to a latch circuit which signals the transportation system speed controller that no vehicle is present between the first and second pathway locations. When the first and second enable signals do not correspond, the signal from the oscillator is not transmitted through both pairs of fail-safe AND gates, there is no signal applied to the fail-safe OR gate, and no signal is applied to the latch circuit which signals the transportation system speed controller that a vehicle is present between the first and second pathway locations.

17 Claims, 3 Drawing Figures

QUAD STATE RECEIVER

CROSS REFERENCE TO RELATED APPLICATIONS

Reference is made to concurrently filed and copending patent applications entitled "Multi-Channel Signal Decoder," Ser. No. 558,108, filed Mar. 13, 1975, on behalf of T. C. Matty and A. Sahasrabudhe; and "Fail-Safe Speed Command Signal Decoder System," Ser. No. 568,226, filed Apr. 15, 1975, on behalf of A. Sahasrabudhe and M McGinty. Each of the referenced applications is assigned to the assignee of the present invention.

BACKGROUND OF THE INVENTION

In a typical transportation vehicle control system of the prior art, comma-free binary coded vehicle control information is transmitted to the transportation vehicles on a frequency modulated (FM), frequency shift key modulated (FSK), or phase shift key modulated (PSK) control signal. This signal is comprised of multiple message frequencies (e.g. 5KC and 10KC) which represent the binary logic conditions (1 and 0). These vehicle control signals have also been used to detect the presence of vehicles within a predetermined section of the vehicle pathway. A receiver compares logic conditions of the vehicle control signal transmitted from a location at one end of the predetermined section of the vehicle pathway with logic conditions detected from signals received at a location on the opposite end of the predetermined section of vehicle pathway. When the logic conditions which are detected do not correspond with the logic conditions of the vehicle control signal which is transmitted, it is presumed that a vehicle is present within the predetermined section of pathway. A problem with vehicle detection systems of the prior art has been that noise along the vehicle pathway, transient responses of the filters of the prior art receivers, and component failures in the prior art receivers, could result in the failure of the receiver to detect the presence of a vehicle, thereby creating an unsafe condition.

These detection failures of prior art receivers were due to the high gain of the limiting amplifier used in those receivers. If transient responses of the filters of the prior art receivers were sufficiently large, they were amplified to a limited maximum level by the limiting amplifier and erroneously detected as either a 1 or a 0 logic condition. If no vehicle control signal were received at the opposite end of the vehicle pathway, noise signals of relatively small amplitude could be amplified to a limited maximum level by the limiting amplifier and again erroneously detected as either a 1 or a 0 logic condition. If a filter of the prior art receiver suffered a failure, the limiting amplifier could also cause the receiver to detect erroneous logic conditions 1 or 0.

Because of the unsafe conditions created by prior art receivers which employed limiting amplifiers, there was a need for a vehicle detection receiver that could improve transportation system safety by eliminating the use of limiting amplifiers.

SUMMARY OF THE INVENTION

Logic conditions in a comma-free binary coded signal transmitted from a first point are compared with logic conditions detected from signals received at a second point along a vehicle pathway. Each frequency in the received signal which is substantially equal to a frequency corresponding to a logic condition is isolated from substantially different frequencies and logic conditions are detected from this frequency alone. The logic conditions detected from each frequency are then compared to establish whether the received signal was accurately detected. If the detected logic conditions are deemed accurate, they are compared with the logic conditions in the transmitted signal. The invention will indicate that a vehicle is present between the first and second points unless the accurately detected logic conditions correspond with the transmitted logic conditions.

In addition the present receiver apparatus is fail-safe in operation in that it will indicate that a vehicle is present for any probable failure mode. Indication that a vehicle is present is deemed to be a safe condition for the transportation system.

PREFERRED EMBODIMENT OF THE INVENTION

Figure 1:
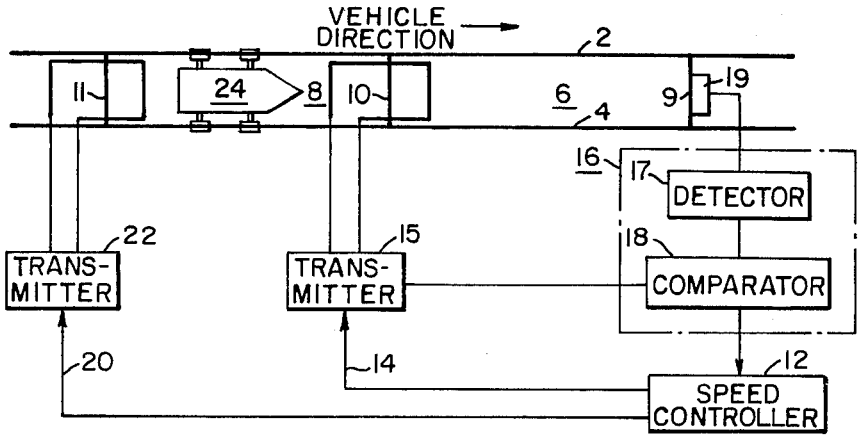
FIG. 1 shows a block diagram of a vehicle detection system utilizing the present receiver apparatus.

FIG. 1 shows a block diagram of a vehicle detection system in which the present receiver apparatus may be used. The vehicle pathway is comprised of continuous metal rails 2 and 4 which are divided into signal blocks 6 and 8 by shorting bars 9, 10 and 11, Speed controller 12 delivers a vehicle speed signal on line 14 to transmitter 15 which transmits the speed signal to the rails 2 and 4 of signal block 6. As explained later, receiver 16 comprised of detector 17 and comparator 18, detects logic conditions in signals received by antenna 19 located at shorting bar 9 and compares these logic conditions with the logic conditions of the signal transmitted by transmitter 15. If there is no vehicle within signal block 6, the logic conditions of the transmitted signal correspond with the logic conditions detected from the received signal and receiver 16 signals speed controller 12 that no vehicle is present within signal block 6. If there is a vehicle within signal block 6, the vehicle's wheels and axles shunt the speed signal around shorting bar 9 so that the logic conditions of the transmitted signal do not correspond with the logic conditions detected from the received signal and receiver 16 signals speed controller 12 that a vehicle is present within signal block 6. Speed controller 12 uses the signal from receiver 16 to establish a vehicle speed which is delivered on line 20 to transmitter 22 and then to rails 2 and 4 in signal block 8. The vehicle 24 within signal block 8 receives the speed signal from the rails 2 and 4.

If there is a vehicle in signal block 6, but it is not detected by receiver 16 because the logic conditions of the transmitted signal correspond with logic conditions erroneously detected from the received signal; or because a noise signal is causing logic conditions to be detected; or because a component of receiver 16 has failed; the speed controller 12 would establish a vehicle speed for signal block 8 without regard to the vehicle present in signal block 6. This would create an unsafe condition for the transportation system.

Figure 2:
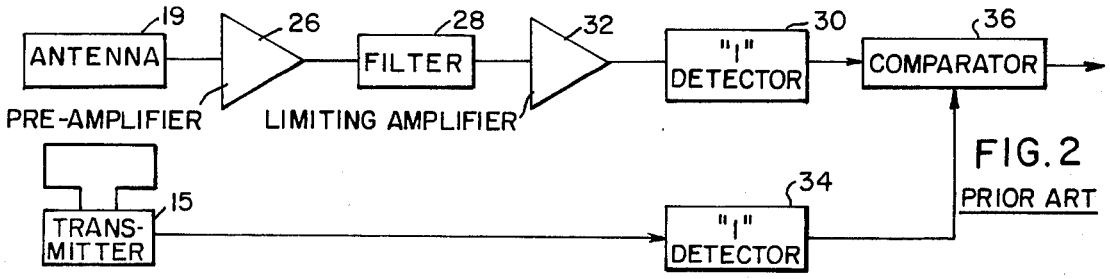
FIG. 2 PRIOR ART
FIG. 2 represents a block diagram of a vehicle detection receiver of the prior art.

FIG. 2 illustrates the typical receiver used in vehicle detection systems of the prior art. The signal received by antenna 19 (FIG. 1) is delivered to a preamplifier 26 which is in communication with a band-pass filter 28. The bandwidth of the filter 28 contains frequencies (e.g. 5KC and 10KC) which correspond to the binary logic conditions 1 and 0. Signals within the bandwidth of filter 28 are delivered to logic detector 30 through limiting amplifier 32. According to the output of limiting amplifier 32, logic detector 30 detects the presence or absence of a logic condition (e.g. 1) corresponding to a particular frequency. According to the signal from transmitter 15, a second logic detector 34 detects the presence or absence of the same logic condition corresponding to the same frequency as detector 30. The logic conditions of detectors 30 and 34 are then compared in comparator 36. If the logic condition detected by detector 30 corresponds with the logic condition detected by detector 34, the speed controller 12 (FIG. 1) is signaled that no vehicle is present in signal block 6. If the logic condition of detectors 30 and 34 do not correspond, the speed controller 12 is signaled that a vehicle is present in signal block 6.

Limiting amplifier 32 is used to establish "capture effect." When no vehicle is present in signal block 6, "capture effect" allows the signal transmitted by transmitter 15 to screen out conflicting noise signals received by antenna 19 so that the logic condition detected by detector 30 is determined by the logic condition of the signal transmitted by transmitter 15. The amplitude of the signal transmitted by transmitter 15 is sufficiently greater than the amplitudes of other signals received by antenna 19 so that the sign of the input to the limiting amplifier 32 is determined by the sign of the signal transmitted by transmitter 15. The gain of the limiting amplifier 32 is high enough that any positive input signal will result in the limited maximum positive output of the limiting amplifier 32, and any negative input signal will result in the limited negative output of the limiting amplifier 32. Therefore, the frequency of the signal transmitted by transmitter 15 determines the frequency of the output of limiting amplifier 32. Since the frequency of the signal transmitted by the transmitter 15 corresponds to the logic condition of transmitter 15 and since the frequency of the output of the limiting amplifier 32 determines the logic condition detected by detector 30, the logic condition of transmitter 15 determines the logic condition detected by detector 30.

The preferred embodiment of the present invention discloses a receiver 16 (FIG. 1) for comparing in a fail-safe manner, the 1 and 0 logic conditions in a comma-free, binary coded vehicle control signal transmitted from transmitter 15 with logic conditions detected from signals received at antenna 19. If the logic conditions detected from the received signals correspond with the logic conditions in the transmitted signals, the disclosed receiver 16 will indicate to the speed controller 12 that signal block 6 is unoccupied. However, if these logic conditions do not correspond due to a vehicle which is present in signal block 6, noise signals received by antenna 19, the transient responses of the filters in the receiver, or the failure of a component in the receiver; the disclosed receiver 16 will indicate to the speed controller 12 that signal block 6 is occupied.

Figure 3:
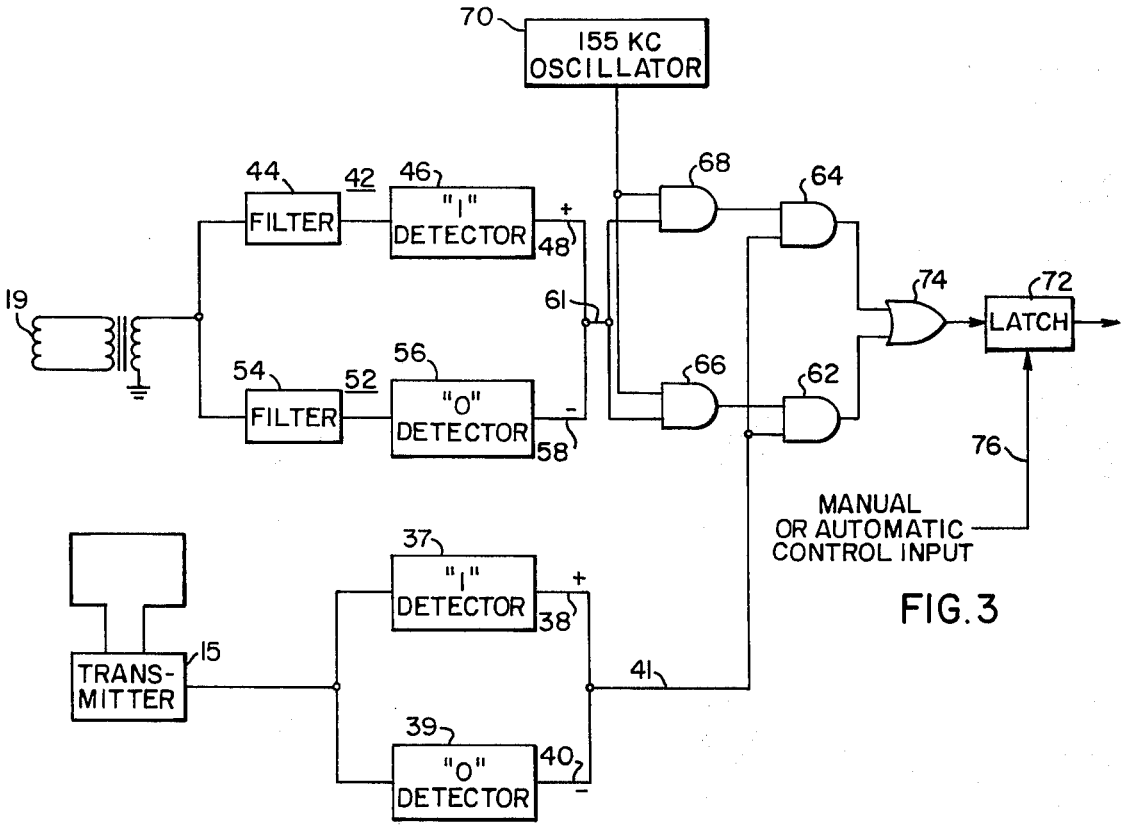
FIG. 3 shows block diagram of the preferred embodiment of the present receiver apparatus.

FIG. 3 is a block diagram of the preferred embodiment of receiver 16. The 1 and 0 logic conditions of the comma-free, binary coded vehicle control signal transmitted from transmitter 15 are each represented by a predetermined frequency. A first logic condition detector 37 is electrically connected to transmitter 15 and detects the presence of the frequency corresponding to the 1 logic condition in the transmitted signal. Logic condition detector 39 is also electrically connected to transmitter 15 and detects the presence of the frequency corresponding to the 0 logic condition in the transmitted signal. When detector 37 detects a 1 logic condition it produces a positive voltage of a predetermined magnitude on line 38 and when detector 39 detects a 0 logic condition it produces a negative voltage of the same magnitude on line 40. Otherwise, lines 38 and 40 are of neutral voltage. Lines 38 and 40 are electrically connected to produce a first enable signal 41 whose voltage is the sum of voltage of lines 38 and 40. Therefore, first enable signal 41 will be positive if detector 37 detects a 1 logic condition and detector 39 does not detect a 0 logic condition. First enable signal 41 will be negative if detector 39 detects a 0 logic condition and detector 37 does not detect a 1 logic condition. If detector 37 detects a 1 logic condition while detector 39 detects a 0 logic condition or if neither detector 37 nor 39 detect any logic condition, first enable signal 41 will be neutral.

Antenna 19 is transformer coupled to logic condition detecting channels 42 and 52. Detecting channel 42 is comprised of band-pass filter 44 and logic detector 46. The bandwidth of band-pass filter 44 contains the frequency of transmitter 15 correspond to the 1 logic condition. Logic detector 46 detects a 1 logic condition when a signal is present to provide a positive voltage of predetermined magnitude on line 48. Detecting channel 52 is comprised of band-pass filter 54 and logic detector 56. The bandwidth of band-pass filter 54 contains the frequency of transmitter 15 corresponding to the 0 logic condition. Logic detector 56 detects a 0 logic condition when a signal is present to provide a negative voltage on line 58 which has the same predetermined magnitude as the positive voltage on line 48. When the signal received by antenna 19 contains the frequency corresponding to a 1 logic condition, that frequency passes through filter 44 so that detector 46 detects a 1 logic condition and provides a positive voltage on line 48. When the signal received by antenna 19 contains the frequency corresponding to a 0 logic condition, that frequency passes through filter 54 so that detector 56 detects a 0 logic condition and provides a negative voltage on line 58 which has the same predetermined magnitude as a positive voltage appearing on line 48. Otherwise, lines 48 and 58 are of neutral voltage. Lines 48 and 58 are electrically connected to produce a second enable signal 61 whose voltage is the sum of the voltage of lines 48 and 58. Therefore, second enable signal 61 will be positive if detector 46 detects a 1 logic condition and detector 56 does not detect a 0 condition. Second enable signal 61 will be negative if detector 56 detects a 0 logic condition and detector 46 does not detect a 1 logic condition. If detector 46 detects a 1 logic condition while detector 56 detects a 0 logic condition or if neither detector 46 nor 56 detect any logic condition, second enable signal 61 will be neutral. First enable signal 41 is provided to the pair of fail-safe AND gates 62, 64 and second enable signal 61 is provided to the pair of fail-safe AND gates 66, 68. Fail-safe AND gates equivalent to those described in U.S. Pat. No. 3,748,497 of David Woods and in U.S. Pat. Application Ser. No. 780,661 of George ThorneBooth, now abandoned would be suitable for use in the present invention. According to the fail-safe AND gates described in those references, when enable signal 41 is positive, fail-safe AND gate 64 will conduct a signal; and when signal 41 is negative, fail-safe AND gate 62 will conduct a signal. Similarly, when enable signal 61 is positive fail-safe AND gate 68 will conduct a signal, and when enable signal 61 is negative fail-safe AND gate 66 will conduct a signal. When enable signals 41 and 61 are both positive, fail-safe AND gates 64 and 68 will both be conductive. When enable signals 41 and 61 are both negative fail-safe AND gates 62 and 66 will both be conductive.

As explained earlier, enable signals 41 and 61 will both be positive only when detectors 37 and 46 detect a 1 logic condition and detectors 39 and 56 do not detect a 0 logic condition. Enable signals 41 and 61 will both be negative only when detectors 39 and 56 both detect a 0 logic condition and detectors 37 and 46 do not detect a 1 logic condition. Fail-safe AND gates 64 and 68 will both become conductive only when detectors 37 and 46 detect a 1 logic condition and detectors 39 and 56 do not detect a 0 logic condition. Fail-safe AND gates 62 and 66 will both become conductive only when detectors 39 and 56 detect a 0 logic condition and detectors 37 and 46 do not detect a 1 logic condition. Therefore, the logic conditions in the signal of transmitter 15 must correspond with the logic conditions detected from the signals received by antenna 19 in order for both fail-safe AND gates 68 and 64 or for both fail-safe AND gates 66 and 62 to be conductive.

An oscillator 70 may provide a constant frequency signal (e.g. 155KC) to a latch circuit 72 either through conductive fail-safe AND gates 68 and 64 and fail-safe OR gate 74 or through conductive fail-safe AND gates 66 and 62 and fail-safe OR gate 74. A suitable oscillator and latch circuit are described in the U.S. Pat. No. 3,751,689 of William Hogg. A suitable fail-safe OR gate is described in the U.S. Pat. application Ser. No. 116,751 of Thomas Matty now abandoned. Once the control input 76 of latch circuit 72 has been set, as long as the latch circuit 72 continues to receive a signal from oscillator 70, it will provide a signal to the speed controller 12 (FIG. 1) indicating that no vehicle is present in signal block 6. Latch circuit 72 will continue to receive a signal from oscillator 70 as long as both fail-safe AND gates 68 and 64 or both fail-safe AND gates 66 and 62 are conductive. As explained earlier, the logic conditions in the signal of transmitter 15 must correspond with the logic conditions detected from the signals received by antenna 19 in order for both fail-safe AND gates 68 and 64 or for both fail-safe AND gates 66 and 62 to be conductive. Therefore, latch circuit 72 will indicate that no vehicle is present in signal block 6 as long as the logic conditions in the signal of transmitter 15 correspond with the logic conditions detected from the signals received by antenna 19.

Once the signal from oscillator 70 to latch circuit 72 has been interrupted, until the control input 76 of latch circuit 72 has been reset, latch circuit 72 will provide no signal to speed controller 12 (FIG. 1) indicating that a vehicle is present in signal block 6. The signal from the oscillator 70 to the latch circuit 72 may be interrupted due to the presence of a vehicle in signal block 6, an error in the detection of the logic conditions of the signal received at antenna 19, noise signals in signal block 6 which cause extraneous logic conditions to be detected, or failure of a filter, detector, fail-safe AND gate, or fail-safe OR gate.

If a vehicle is present in signal block 6, the wheels and axles of the vehicle will shunt the signal of transmitter 15 around antenna 19. This causes the logic conditions detected from the signals received by antenna 19 to differ from the logic conditions of the signal of transmitter 15 so that neither fail-safe AND gates 64 and 68 nor fail-safe AND gates 62 and 66 are conducting concurrently. When fail-safe AND gate 64 does not conduct concurrently with fail-safe AND gate 68 nor does fail-safe AND gate 62 conduct concurrently with fail-safe AND gate 66, there is no path for the signal from oscillator 70 to latch circuit 72 and latch circuit 72 will indicate that a vehicle is present in signal block 6. This was the condition that the vehicle detection system was intended to detect.

However, the logic conditions detected from the signal received by antenna 19 may not correspond to the logic conditions of the signal of transmitter 15 due to noise signals received by antenna 19. Since noise signals are of a single constant frequency, noise signals will affect only that detecting channel 42 or 52 whose bandwidth contains the frequency of the noise signal. Since the logic conditions 1 and 0 are independently detected in two isolated channels 42 and 52, one of these channels will be unaffected by the noise signal and continue to detect logic conditions of signals within its bandwidth including (when there is no vehicle present in signal block 6) the signal of transmitter 15. When the unaffected channel detects a logic condition that does not correspond to the logic condition of the noise signal, lines 48 and 58 will have voltages which are equal in magnitude but opposite in polarity so that enable signal 61 will be neutral, neither fail-safe AND gate 68 or 66 will conduct, and the signal from oscillator 70 to latch circuit 72 will be interrupted causing latch circuit 72 to indicate that circuit block 6 is occupied.

Similarly, the logic conditions detected from the signal received by antenna 19 may not correspond to the logic conditions of the signal of transmitter 15 due to errors in the detection of the logic conditions of the signal received by antenna 19. Typically, errors in detection are caused by the transient responses of filters 44 or 54 or by component failures of filters 44 or 54 or detectors 46 or 56. When either channel 42 or 52 detects an erroneous logic condition which is not coterminous with the detection of a complementary erroneous logic condition in the other channel, lines 48 and 58 again will have voltages which are equal in magnitude but opposite in polarity so that enable signal 61 will be neutral, neither fail-safe AND gate 68 or 66 will conduct, and the signal from oscillator 70 to latch circuit 72 will be interrupted causing latch circuit 72 to indicate that circuit block 6 is occupied. The probability that both channels 42 and 52 will detect coterminous, complementary, erroneous logic conditions is considered so remote that it does not warrent protection.

Even though logic conditions detected from the signal received by antenna 19 do correspond to the logic conditions of the signal of the transmitter 15, the signal from oscillator 70 to latch circuit 72 may be interrupted by a component failure of fail-safe AND gates 62, 64, 66 or 68 or a component failure or fail-sage OR gate 74. As explained in the aforementioned references, any probable failure of these devices will cause them to permanently assume a non-conducting state. Since these components are directly in the electrical path from oscillator 70 to latch circuit 72, their failure will cause latch circuit 72 to indicate that signal block 6 is occupied.

An indication that a signal block is occupied is deemed to be the vehicle detection system condition that is safest for transportation vehicle passengers. The disclosed receiver is therefore said to be fail-safe in the sense that probable errors in the detection of the logic conditions of the signal received at antenna 19, noise signals in signal block 6 which cause extraneous logic conditions to be detected, or failure of components in a filter, detector, fail-safe AND gate, or fail-safe OR gate will cause the vehicle detection system to assume the condition that is safest for transportation vehicle passengers.

We claim:

1. In a transportation vehicle detection system which compares the logic conditions contained in signals transmitted at a first point with logic conditions detected from signals received at a second point, the apparatus including:

first means for filtering said received signals in relation to a first predetermined frequency;

second means for filtering said received signals in relation to a second predetermined frequency;

third means for detecting first logic conditions from said signals filtered by said first filtering means;

fourth means for detecting second logic conditions from said signals filtered by said second filtering means where said second logic conditions are complementary to said first logic conditions;

means for providing an enabling signal in relation to said first and second complementary logic conditions;

means for comparing the logic conditions in said transmitted signals with said enabling signal provided in relation to said first and second complementary logic conditions; and means for indicating that a vehicle has been detected between said first and second points in relation to said comparing means.

2. The apparatus of claim 1 with said first filtering means being operative with one of said third and fourth detecting means, and with said second filtering means being operative with the other of said third and fourth detecting means.

3. The apparatus of claim 2 in which a vehicle is detected in relation to the uncomplemented logic conditions of said third and fourth detecting means which are erroneously detected.

4. The apparatus of claim 3 in which said comparing means is comprised of fail-safe logic gates.

5. In a receiver for detecting logic conditions from a non-comma, binary coded message including first and second message frequencies, the apparatus comprising:

first means for filtering signals which are substantially equivalent to said first message frequency;

second means for filtering signals which are substantially equivalent to said second message frequency;

third means for detecting first logic conditions in relation to signals filtered by said first filtering means where one of said first and second filtering means is operative with said third detecting means;

fourth means for detecting second logic conditions in relation to signals filtered by said second filtering means where the other of said first and second filtering means is operative with said fourth detecting means and where said second logic conditions are complementary to said first logic conditions; and means for comparing said first logic conditions detected by said third detecting means with said second logic conditions detected by said fourth detecting means.

6. The apparatus of claim 5 in which said comparing means indicates uncomplementary detection errors made by said first and second detecting means.

7. In a transportation vehicle detection system which compares logic conditions of signals transmitted at a first point with logic conditions detected from signals received at a second point, the apparatus comprising:

first detector means for detecting a first logic condition of said transmitted signals;

second detector means for detecting a second logic condition of said transmitted signals where said second logic conditions are complementary to said first logic conditions;

first enabling means for providing an enable signal in relation to the combination of said first and second detecting means;

first detecting channel means for detecting a first logic condition of said received signals;

second detecting channel means for detecting a second logic condition of said received signals; where said second logic conditions are complementary to said first logic conditions;

second enabling means for providing an enable signal in relation to the combination of said first and second detecting channel means; and means for comparing the output of said first enabling means with the output of said second enabling means to determine the presence of a vehicle between said first and second points.

8. The apparatus of claim 7 in which said first enabling means includes first and second lines which are connected to provide a first enable signal in relation to the output voltages of said first and second detector means, and in which said second enabling means includes a third and fourth lines which are connected to provide a second enable signal in relation to the output voltage of said first and second detecting channel means.

9. The apparatus of claim 7 in which said first enabling means provides:

a positive output in response to said first logic condition detected by said first detector means;

a negative output in response to said second logic conditions detected by said second detector means; and a neutral output in response to said first logic condition detected by said first detector means while said second logic condition is detected by said second detector means.

10. The apparatus of claim 7 in which said second enabling means provides:

a positive output in response to said first logic condition detected by said first detecting channel means;

a negative output in response to said second logic condition detected by said second detecting channel means; and a neutral output in response to said first logic condition detected by said first detecting channel means while said second logic condition is detected by said second detecting channel means.

11. The apparatus of claim 7 in which said first detecting channel means includes:

a first means for filtering signals equivalent to a predetermined frequency associated with said first logic condition of said received signals; and a first means for detecting logic conditions in relation to the output of said first filtering means.

12. The apparatus of claim 7 in which said second detecting channel means includes:

means for filtering signals equivalent to a predetermined frequency associated with said second logic condition of said received signals; and means for detecting logic conditions in relation to the output of said second filtering means.

13. The apparatus of claim 7 in which said comparing means includes:

first fail-safe logic gate means for conducting a signal in relation to a negative polarity of said first enabling means; and second fail-safe logic gate means for conducting a signal in relation to a positive polarity of said first enabling means.

14. The apparatus of claim 7 in which said comparing means includes:

fail-safe logic gate means for conducting a signal in relation to a negative polarity of said second enabling means; and fail-safe logic gate means for conducting a signal in relation to a positive polarity of said second enabling means.

15. The apparatus of claim 7 in which said comparing means includes:

fail-safe OR gate means conductive in relation to a negative polarity of said first and second enabling means and conductive in relation to a positive polarity of said first and second enabling means.

16. The apparatus of claim 7 including:

means for indicating the presence of a vehicle in relation to the output of said comparing means.

17. The apparatus of claim 16 with said indicating means comprising:

oscillator means for providing a signal to said comparing means; and latch means for indicating that a vehicle is present unless provided with the signal of said oscillator means by said comparing means.

* * * * *